US006863092B2

(12) United States Patent
Seiver et al.

(10) Patent No.: US 6,863,092 B2
(45) Date of Patent: Mar. 8, 2005

(54) APPARATUS AND METHOD FOR FILLING LIQUID CONTAINERS

(75) Inventors: Michael J. Seiver, Houston, TX (US); Donald H. Green, Freeport, TX (US)

(73) Assignee: Specialty Equipment Conveyor Company, Houston, TX (US)

( * ) Notice: Subject to any disclaimer, the term of this patent is extended or adjusted under 35 U.S.C. 154(b) by 0 days.

(21) Appl. No.: 10/691,488

(22) Filed: Oct. 24, 2003

(65) Prior Publication Data

US 2004/0089373 A1 May 13, 2004

Related U.S. Application Data

(60) Provisional application No. 60/421,509, filed on Oct. 28, 2002.

(51) Int. Cl.[7] ..... B65B 1/04; B65B 3/04

(52) U.S. Cl. ..... 141/2; 141/18; 141/94; 141/129; 141/156; 141/181; 141/270; 141/374; 53/367

(58) Field of Search ..... 141/2, 18, 94, 141/129, 180, 181, 256, 270, 374; 53/266.1, 281, 285, 367

(56) References Cited

U.S. PATENT DOCUMENTS 6,053,219 A * 4/2000 Seiver ..... 141/83

6,725,980 B2 * 4/2004 Larkin ..... 188/72.3

* cited by examiner

*Primary Examiner*—Timothy L. Maust

(74) *Attorney, Agent, or Firm*—Bill B. Berryhill

(57) ABSTRACT

Method and apparatus for filling containers with liquid of the type having a tubular filling lance operatively connected to a source of liquid and being vertically moveable between raised positions above said containers and lowered positions, when coaxially aligned with a filling hole in one of said containers, extending through said filling hole into said container for filling thereof. The apparatus comprises a conveyor assembly on which two or more containers with randomly disposed filling holes may be moved to a filling station generally below the filling lance. A carriage assembly is provided by which the filling lance may be moved in X, Y, Z coordinates, first to a raised position coaxially aligned with a selected one of the container filling holes and then to a lowered position into a selected container. An electronic sensor senses the location of each of the container filling holes and a controller connected to the electronic sensor and the carriage assembly moves the filling lance to coaxial alignment with the selected container filling hole and then into the selected container for filling thereof.

11 Claims, 1 Drawing Sheet

APPARATUS AND METHOD FOR FILLING LIQUID CONTAINERS

CROSS REFERENCE TO RELATED APPLICATION

This application is based on Provisional Application Ser. No. 60/421,509 filed Oct. 28, 2002.

BACKGROUND OF THE INVENTION

1. Field of the Invention

The present invention pertains to apparatus and methods for filling containers with liquid. More specifically, the present invention pertains to container filling apparatus and methods of the use thereof which are provided with a vertically disposed tubular filling lance operatively connected to a source of liquid and to a power device by which the lance may be moved between raised positions above the containers and lowered positions, when coaxially lined with a filling hole of the container, so as to extend through the filing hole and into the container for filling with liquid.

2. Description of the Prior Art

There are many designs for filling containers with liquid. Some of the most successful and efficient designs are those of the type having a tubular filling lance which is operatively connected to a source of liquid and which is vertically moveable by a power device between raised and lowered positions. The lance is positioned above an opening in the container and lowered into the container for filling thereof. After the container is filled, the lance is returned to a fully raised and/or withdrawn position. For ease and efficiency of handling, two or more, frequently four, empty containers are placed on wooden pallets and moved along a conveyor to a filling station at which the filling lance is located. The filling hole closures are removed in some fashion prior to reaching the filling station. Unless the openings are oriented in some fashion prior to reaching the filling station, they will be at random locations. Even if the openings are oriented in a preselected fashion, some mechanism must be provided for moving the vertical filling lance to a coaxially aligned position with each of the fill openings so that the tubular lance may be lowered into the drum for the filing thereof. In most designs of the prior art, this requires manual direction and manipulation of the lance. Manual manipulation requires an operator and slows what might otherwise be considered an automatic operation. The present invention alleviates this problem.

SUMMARY OF THE PRESENT INVENTION

The present invention provides apparatus and methods for automatically filling containers (or drums), the upper ends of which are provided with fill openings (or bungholes) and in which two or more of the drums are supported on a pallet for moving along a conveyor to a filling station. Like most drum filling systems, the filling station is provided with a vertically disposed tubular filling lance which is operatively connected to a source of liquid and to a power device by which the lance may be moved between raised positions above the drums and lowered positions, when coaxially aligned with one of the drum fill openings (or bungholes), extending through the opening and into the drum for filling the drums with liquid.

The tubular filing lance of the present invention is uniquely carried on lance supporting apparatus by which the filling lance may be horizontally moved in two directions above the drums, along an X-axis perpendicular with movement of the conveyor and along a Y-axis perpendicular to the X-axis (parallel to movement of the conveyor). Movement along the X and Y axes is facilitated by a gantry type arrangement in which lance carriage supporting members move (X-axis movement) along parallel rails of a gantry frame. Movement along the Y-axis is facilitated by a lance carriage on which the lance is supported and which is moveable along the gantry support members in directions perpendicular to the gantry rails (Y-axis movement).

A photoelectric sensing device is located at the filling station and above the drums for simultaneously sensing the location of each of the drum fill openings, regardless of their orientation. Controls are operatively connected to the photoelectric sensor and the lance supporting apparatus to selectively position the lance, by movement along the X and Y axes for coaxial alignment with each of the fill openings and for subsequently signaling the power device for lowering the lance through the fill openings in each of the drums for the filling thereof. After all of the drums on the pallet are filled, the pallet is transported by the conveyor system to a location where the openings are closed with a bung or closure member and the drums are moved to a location for further handling for storage or shipment.

The apparatus and method of the present invention results in automatic filling of two or more drums located on a pallet without having to orient each of the drum fill openings and without having to provide an operator to manually align the filling lance with each of the openings thereof. A number of other objects of the invention will be apparent from reading the description in conjunction with the accompanying drawings.

DESCRIPTION OF A PREFERRED EMBODIMENT OF THE INVENTION

Figure 1:
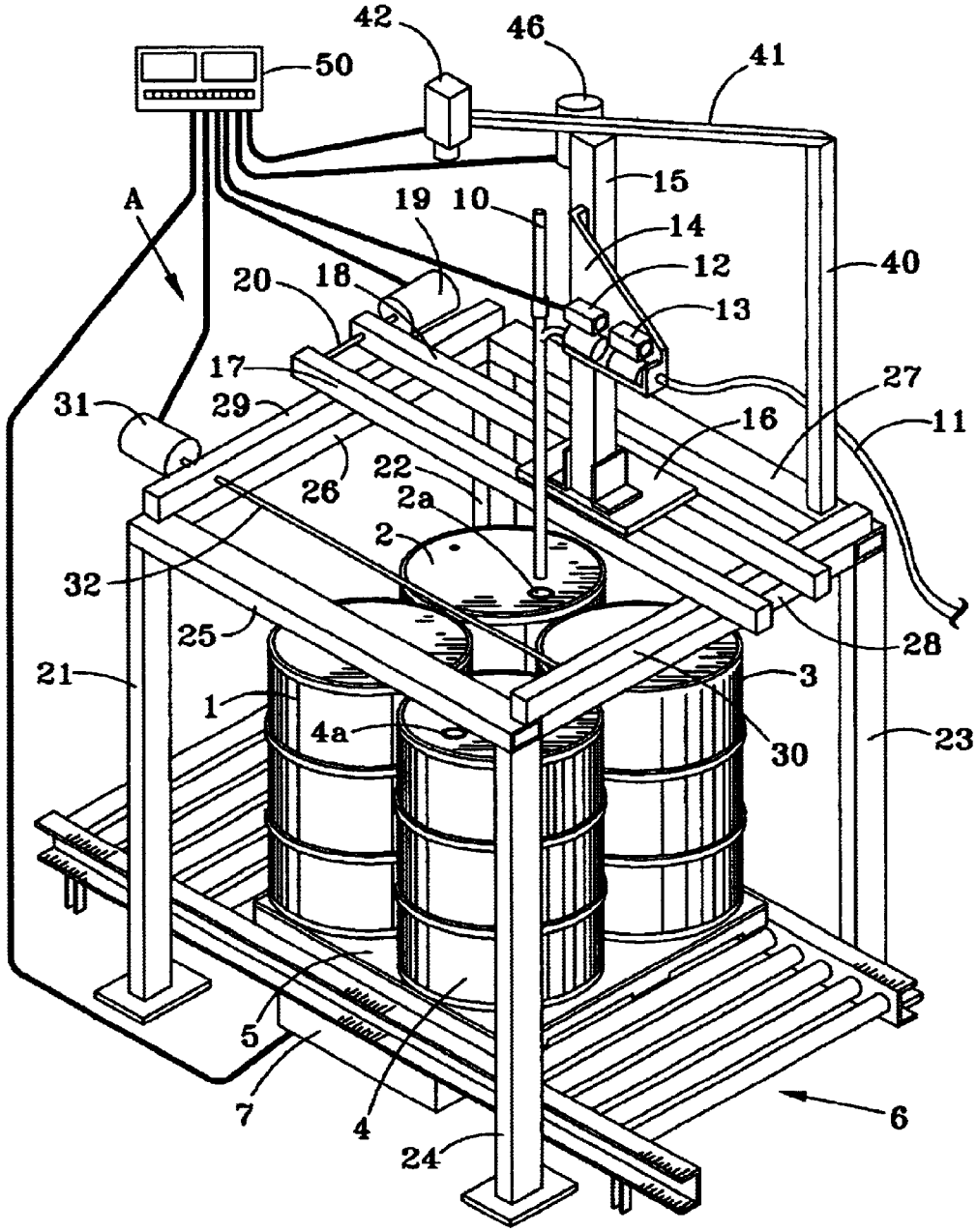
FIG. 1 is a perspective view of the automatic filling apparatus of the present invention, according to a preferred embodiment thereof.

Referring to FIG. 1, there is shown apparatus A for automatically filling containers such as drums 1, 2, 3 and 4 with liquid. The drums 1, 2, 3 and 4 are placed on a pallet 5 and moved on a conveyor, a portion of which is represented at 6 in FIG. 1. The empty drums are placed on the pallet 5 at some supply location and moved by an elongated conveyor, of which the portion 6 forms a part, to a filling station as represented in FIG. 1. Below the conveyor portion 6 is a scale 7 which is capable of weighing the drums 1–4 and the pallet 5.

At the filling station is provided a vertically disposed tubular filling lance 10 which is operatively connected through a hose 11 or the like to a source of liquid (not shown). The lance 10 and valve and valve actuator assemblies 12 and 13, by which flow between the supply hose 11 and lance 10 is controlled, are attached to a lance carriage 14 which is mounted on a vertical mast 15 for vertical up and down movement thereon. A power device 46 is attached to the mast and is operatively connected to the lance carriage 14 for the up and down movement thereof. Since the lance 10 is supported by the mast carriage 14, the power device 46 is therefore effective in moving the lance 10 between raised positions above the drums 1, 2, 3 and 4 as shown in FIG. 1 and lowered positions, when coaxially aligned with one of the drum filing holes (two of which are shown at 2*a* and 4*a*), extending through the filing hole and into the container of the drum for filling the drums with liquid.

There are a number of designs for the construction of such vertically moveable filling lances. More details of such construction and the operation thereof in a particularly well accepted design may be seen in U.S. Pat. No. 6,053,219.

The mast 15 is attached to and extends upwardly from a mast carriage 16 which is mounted on parallel rails 17 and 18 for movement which is generally parallel to movement of the conveyor 6. A power device 19 would be mounted at the end of the rail 17 and 18 for driving a shaft 20 which may in turn drive one or more gears and chains or other mechanisms (not shown) for moving the mast carriage 16 and the mast 15, the lance carriage 14 and the lance 10 in a direction parallel with movement of the conveyor 6 which we refer to in X, Y, Z coordinates as the Y-axis.

The rails 17, 18, mast carriage 16, mast 15, lance carriage 14 and the lance 10 are all supported above the drums 1, 2, 3 and 4 on a gantry frame made up of vertical supports 21, 22, 23 and 24 and horizontal supports 25, 26, 27 and 28. A pair of parallel rails 29 and 30 are carried by the gantry frame and the rails 17 and 18 rest thereon for transverse movement in a direction perpendicular to movement of the conveyor 6, a direction in X, Y, Z coordinates which we refer to as the X-axis. A power device 31 connected to a rotating shaft 32 drives gears, chains or other mechanisms (not shown) which are operatively connected to the rails 29 and 30 for the movement thereof along said X-axis.

Affixed to and vertically extending from one of the horizontal members 27 of the gantry frame, is a stationary vertical support 40 from which extends a horizontal arm 41 at the distal end of which is mounted an electronic or photoelectric sensing scanner 42 which, when the drums are located at the filling station such as in FIG. 1, is capable of scanning and recording in X, Y coordinates the location of the filling hole or bunghole in each one of the drums 1, 2, 3 and 4.

The actuator and valve assemblies 12, 13 and the power devices 19, 31 and 46 are all operatively connected to a controller 50 which includes a computer which is also operatively connected to the photoelectric scanner 42. The controller is also connected to scale 7.

In operation, a fork-lift (not shown) loads an empty conveyor with the pallet 5 and the four drums 1, 2, 3 and 4 thereon. The bungs or fill opening closures have been previously removed to leave the bunghole or fill opening opened. The pallet 5 advances to an unoccupied accumulation zone in route to the filling station of FIG. 1. Upon appropriate signal, the pallet 5 loaded with empty drums 1–4 advances to the position shown in FIG. 1. Upon arrival, a photo-eye (not shown) may be used to recognize the pallet and signal the control system to stop the conveyor.

At this point, the mast carriage 16, mast 15 and lance carriage 14 and lance 10 have all been moved toward the horizontal support 27 of the gantry frame so that all of these components are clear of the drums 1, 2, 3 and 4, leaving an unobstructed view of the ends thereof from the electronic scanner or photoelectric sensor 42 thereabove. The electronic scanner 42 scans the four drum cluster and identifies each bunghole or fill opening. It then reports the X and Y coordinates of each bunghole to the controller 50. The controller computer determines the shortest distance to the closest drum bunghole (bunghole 2*a* of drums 2 in FIG. 1) and the computer in cooperation with the control system activates power devices 19 and 31 so as to position the lance 10 directly above and in coaxial alignment with the bunghole 2*a*. The computer, in cooperation with the scale 7, computes the tare weight, set points and tracking information for the lance 10. A signal from controller 50 then activates the power device 46 to lower the lance carriage 14 causing the lance 10 to extend into the fill hole or bunghole 2*a* of the first drum 2. The lance 10 moves through its downward path (Z-axis) into the drum and then stops at a predetermined distance from the bottom.

Once the lance reaches the proper bottom position, the valve and the actuator assemblies 12 and 13 are operated to first allow liquid to flow through the hose 11 and lance 10 at a slow fill rate until reaching a predetermined level to prevent foaming of the liquid product. When the slow fill level is reached, both valves 12, 13 are fully opened for fast fill mode. This continues until a predetermined weight is achieved (approximately 90% full). Then the valves 12, 13 are again repositioned for a slow fill mode until the drum is filled. Flow is shut off and the lance 10 is raised (Z-axis) to its home position.

The computer then signals the power devices 19 and 31 of the gantry system to position the lance 10 to the X, Y coordinates of the next closest drum bunghole. Its. arrival signals the computer to activate the control signal for repeating the cycle, lowering the lance 10, filling the second drum and removing the lance 10. The cycle is repeated for the third and fourth drum.

After the fourth drum is filled, the weight is calculated and recorded by the computer. The computer then signals the conveyor to start, allowing the fully loaded pallet 5 to move out of the filling station as another pallet of empty drums is conveyed thereto for filling.

After the drum openings are closed or rebunged, the pallet 5, loaded with full drums 1–4, is conveyed to the end of the system and to the next available accumulation zone (not shown) of an outfeed conveyor system. The forklift may remove each full load from the end of the outfeed conveyor and a photo eye may be used to recognize when it is gone. This would then signal the controller 50 to start subsequent conveyor zones allowing all the loads to advance one position.

Thus, the unique apparatus and method of the present invention utilizes an electronic sensing device for simultaneously sensing the location of each bunghole or fill opening of a plurality of drums located on a pallet, regardless of their orientation. The locations are sent to a computer to which controls are operatively connected for moving lance supporting apparatus to selectively position the lance by movement along X and Y axes for coaxial alignment with each of the fill openings and for subsequently signaling the power device for lowering the lance (Z-axis) through the fill openings in each of the drums for the filling thereof.

The primary object and advantage of the apparatus and method of the present invention is the automatic filling of two or more drums located on a pallet without having to orient each of the drum fill openings and without having to provide an operator to align the fill openings thereof. However, other objects and advantages of the invention will be apparent. While a preferred embodiment of the invention has been described herein, those skilled in the art will be able to design many variations thereof without departing from the spirit of the invention. Accordingly, it is intended that the scope of the invention be limited only by the claims which follow.

What is claimed is:

1. Apparatus for filling containers with liquid of the type having a tubular filling lance operatively connected to a source of liquid and being vertically moveable between raised positions above said containers and lowered positions, when coaxially aligned with a filling hole in one of said containers, extending through said filling hole into said container for filling thereof, said apparatus comprising:

a conveyor assembly on which two or more of said containers may be moved to a filling station generally below said filling lance, the filling holes of said containers being randomly disposed;

a gantry frame located at said filling station and under which said containers may be moved by said conveyor assembly to said filling station;

a carriage assembly supported on said gantry frame and by which said filling lance may be moved in X, Y, Z coordinates; where the X axis is horizontal and transverse to movement of said conveyor means, the Y axis is horizontal and perpendicular to said X axis and the Z axis is vertical; first to a raised position coaxially aligned with a selected one of said container filling holes and then to a lowered position into said selected container;

an electronic sensor positioned above said gantry frame for sensing, in X and Y coordinates, the location of each of said container filling holes; and a controller connected to said electronic sensor and to said carriage assembly for activation of said carriage assembly for movement of said filling lance to said coaxial alignment with said selected one of said container filling holes and then to said lowered position into said selected container for filling thereof.

2. Container filling apparatus as set forth in claim 1 in which said gantry frame comprises support members on which said carriage assembly is supported for horizontal movement relative to said X and Y axes.

3. Container filling apparatus as set forth in claim 2 including a first pair of spaced apart rails supported by said gantry frame and a second pair of spaced apart rails supported on said first pair of rails for movement by a corresponding power device in directions perpendicular to said Y axis.

4. Container filling apparatus as set forth in claim 3 in which said carriage assembly comprises a mast carriage upwardly from which extends a vertical mast which supports a lance carriage to which said filing lance is attached and by which said filling lance may be moved by a corresponding power device between said raised and lowered positions.

5. Container filling apparatus as set forth in claim 1 in which said carriage assembly comprises a mast carriage and a lance carriage, said mast carriage supporting a vertical mast and being operably connected to one or more power devices for positioning of said mast in X, Y coordinates in response to signals from said controller, said filling lance being carried by said lance carriage which is supported on said vertical mast and which is operably connected to a power device for movement of said filling lance between said raised and lowered positions in response to signals from said controller.

6. Container filling apparatus as set forth in claim 5 in which said carriage assembly comprises a first pair of spaced apart horizontal rails on which a second pair of spaced apart horizontal rails are supported for transverse movement relative to movement of said containers by said conveyor assembly, said mast carriage being mounted on said second pair of rails for parallel movement relative to movement of said containers by said conveyor assembly.

7. Apparatus for filling containers with liquid of the type having a tubular filling lance operatively connected to a source of liquid and which is vertically moveable between raised positions above said container and lowered positions when coaxially aligned with a filling hole of a selected one of said containers, so as to extend through said filling hole and into said container for filling thereof with liquid, said apparatus comprising:

a conveyor assembly on which two or more containers, having upwardly opening filling holes therein, may be placed and moved to a filling station generally below said filling lance, said filing holes being randomly located;

a gantry frame located at said filling station having vertical support members supporting at least a pair of spaced apart horizontal support members beneath which said containers may be moved by said conveyor assembly to said filling station and on which are provided a first pair of spaced apart rail members and a second pair of spaced apart rail members, perpendicular to said first pair of rail members, the ends of which are supported on said first pair of rail members for movement by a corresponding power device in direction perpendicular to movement of said conveyor assembly;

a mast carriage, upwardly from which extends a vertical mast, supported on said second pair of rail members for movement by a corresponding power device in directions parallel to movement of said conveyor assembly;

a lance carriage to which said filling lance is attached, supported on said mast for vertical movement by a corresponding power device for effecting movement of said filling lance between said raised and lowered positions;

an electronic scanner positioned above said filing station for sensing in X, Y coordinates, the location of said container filling holes when said containers are located at said filing station; and a controller connected to said electronic scanner and each of said power devices for activating said power devices to move said mast carriage until said filling lance is coaxially aligned with a selected one of said container filling holes and subsequently to move said filling lance from a raised position to a lowered position through said selected filling hole and into its container for filling with liquid.

8. Container filling apparatus as set forth in claim 7 in which said corresponding power device of said rail member and said mast carriage comprises rotating shafts connected by power transmission mechanisms to said second pair of rail members and said mast carriage for effecting said movement thereof.

9. Container filling apparatus as set forth in claim 7 in which said conveyor assembly and said gantry frame are designed to accept a pallet on which four of said containers are carried with randomly disposed filling holes for movement to said filling station, said filling lance being moveable on said mast carriage to coaxial positions aligned with any one of said randomly disposed holes.

10. A method of filling containers with liquid utilizing apparatus which includes a filling lance operatively connected to a source of liquid and vertically moveable between raised positions above said containers and lowered positions extending through filling holes in said containers for filling thereof, said method comprising:

conveying two or more containers to said filling station, the filling holes of which are randomly disposed;

sensing the location of each filling hole of each of said containers;

transmitting the location of each of said filing holes to a controller which is connected to power assemblies capable of positioning said filling lance, horizontally in X, Y coordinates; where the X axis is horizontal and transverse the direction of conveying said containers to said filing station and where the Y axis is horizontal and perpendicular to said X axis; and along a Z axis which is vertical;

moving said filling lance in response to said controller and said power assemblies to a position directly above a selected one of said filling holes; and lowering said filling lance in response to said controller and power assemblies through a selected one of said filling holes into its corresponding container for filling with liquid.

11. The method of claim 10 in which said power assemblies comprise horizontally moveable carriages on which said filling lance is supported for positioning in X and Y coordinates and a vertically moveable carriage on which said filling lance is supported for said Z axis vertical movement between said raised and lowered positions.

* * * * *